US007594553B2

(12) United States Patent
Tank et al.

(10) Patent No.: US 7,594,553 B2
(45) Date of Patent: Sep. 29, 2009

(54) COMPOSITE TOOL INSERT

(76) Inventors: Klaus Tank, 9 Warbleton Avenue, Essexwold, 2001 Johannesburg (ZA); Raymond Albert Chapman, 183 Columbine Avenue, Mondeor, 2001 Johannesburg (ZA); Roy Derrick Achilles, 608 San Martinho, Leicester Road, Bedfordview, 2007 (ZA)

( * ) Notice: Subject to any disclaimer, the term of this patent is extended or adjusted under 35 U.S.C. 154(b) by 0 days.

(21) Appl. No.: 10/533,269

(22) PCT Filed: Sep. 12, 2003

(86) PCT No.: PCT/IB03/03921

§ 371 (c)(1),
(2), (4) Date: Dec. 19, 2005

(87) PCT Pub. No.: WO2004/040096

PCT Pub. Date: May 13, 2004

(65) Prior Publication Data

US 2006/0099895 A1 May 11, 2006

(30) Foreign Application Priority Data

Oct. 30, 2002 (ZA) ..... 2002/8778

(51) Int. Cl.
*E21B 10/56* (2006.01)

(52) U.S. Cl. ..... 175/379; 175/426

(58) Field of Classification Search ..... 175/379, 175/426, 434; 407/30, 119; 408/548, 40; 51/295, 307, 293, 309
See application file for complete search history.

(56) References Cited

U.S. PATENT DOCUMENTS

| | | | | |
|---|---|---|---|---|
| 4,255,165 | A * | 3/1981 | Dennis et al. | 51/309 |
| 5,979,571 | A | 11/1999 | Scott et al. | |
| 6,187,068 | B1 | 2/2001 | Frushour et al. | |
| 6,258,139 | B1 * | 7/2001 | Jensen | 51/307 |
| 2002/0074168 | A1 | 6/2002 | Matthias et al. | |

FOREIGN PATENT DOCUMENTS

| | | | |
|---|---|---|---|
| EP | 0462955 | A1 * | 12/1991 |
| EP | 0582484 | A1 * | 2/1994 |

* cited by examiner

*Primary Examiner*—Kenneth Thompson
(74) *Attorney, Agent, or Firm*—Frommer Lawrence & Haug LLP; Ronald R. Santucci

(57) ABSTRACT

A tool insert comprises a substrate (10) having a support surface and a support ring extending laterally from the support surface. The support ring is sized to define a recess (14) within the confines thereof and a shelf about the periphery thereof. A layer (12) of ultra-hard abrasive material is located within the recess and bonded to the substrate and the support ring (16), and presents a primary cutting edge (22) for the tool insert. A protective layer (18) is bonded to the shelf about the support ring so as to protect the primary cutting edge. The protective layer provides a secondary cutting edge (20) for the tool insert, the depth of the protective layer being selected so as to be sufficient to protect the primary cutting edge whilst cutting, milling or drilling through a first substance but to expose the primary cutting edge upon encountering a second substance.

4 Claims, 1 Drawing Sheet

COMPOSITE TOOL INSERT

This application is a 371 of PCT/IB2003/003921 filed on Sep. 12, 2003,published on May 13, 2004 under publication number WO 2004/040096 A1 and claims priority benefits of South African Patent Application No. ZA 2002/8778 filed Oct. 30, 2002.

BACKGROUND OF THE INVENTION

THIS invention relates to a tool insert.

The use of diamond compacts, also known as PCD, as cutting elements are well known in the art and used extensively in various cutting, drilling, milling and other abrasive operations due to the high abrasion resistant properties of diamond cutters. The diamond cutters, however, are not always suitable for all substrates encountered. For instance, it is well established that diamond cutters cannot be used satisfactorily for milling or drilling through ferrous substrates such as steel. As a result, the use of diamond cutters in certain down the hole drilling operations is not suitable as milling through a steel casing, which is used to line the vertical borehole or shaft, is required.

As PCD is not suitable for drilling through the steel casing due to reactions with the ferrous materials, an alternative drill bit insert is required. Accordingly, tungsten carbide cutters are typically used in the drill bit to mill through the steel casing. Once through the casing, the tungsten carbide inserts have to be replaced with abrasive resistant cutters such as diamond cutters in order to drill into the bedrock. This means that the drill bit has to be removed and replaced with an appropriate bit. As the drill strings that have to be removed are very long, this is a time consuming exercise that results in costly downtime.

SUMMARY OF THE INVENTION

According to the invention, a tool insert comprises:

- a substrate having a support surface and a support ring extending laterally from the support surface, the support ring being sized to define a recess within the confines thereof and a shelf about the periphery thereof;
- a layer of ultra-hard abrasive material located within the recess and bonded to the substrate and the support-ring, the layer of ultra-hard abrasive material having a top surface, a portion of the periphery of the top surface providing a primary cutting edge for the tool insert; and
- a protective layer bonded to the shelf about the support ring so as to protect the primary cutting edge, a periphery of the protective layer providing a secondary cutting edge for the tool insert, the depth of the protective layer being selected so as to be sufficient to protect the primary cutting edge whilst cutting, milling or drilling through a first substance but to expose the primary cutting edge upon encountering a second substance.

BRIEF DESCRIPTION OF THE DRAWINGS

The invention will now be described in more detail, by way of example only, with reference to the accompanying drawings in which.

DESCRIPTION OF EMBODIMENTS

Figure 1:
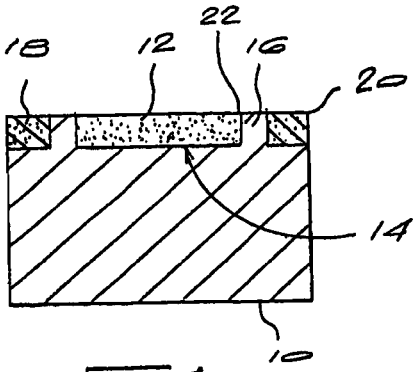
FIG. 1 is a sectional side view of an embodiment of a tool insert of the invention.
Figure 2:
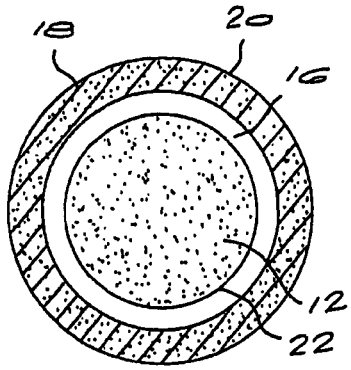
FIG. 2 is a plan view of the tool insert of FIG. 2.

Referring to FIGS. 1 and 2, of the accompanying drawings, an embodiment of a tool insert of the invention is shown. The tool insert comprises a tungsten carbide substrate 10, a PCD layer 12 located within a recess 14 and surrounded by an annular section or ring 16 of tungsten carbide extending laterally from a support surface 17, and a protective layer or ring 18 surrounding the ring 16.

The protective ring 18 may be formed of a different grade of tungsten carbide to that of the substrate 10 or, alternatively, be formed of tool steel or other appropriate material. The choice of material is dependent on the substance or substrate to be milled, drilled or cut before exposing the PCD layer 12. The protective ring 18 can be formed in situ or, alternatively, can be formed as a separate ring component which is attached to the tool insert. The protective ring 18 may be attached to the tool insert, which has been machined to accept the ring, for example by brazing, press fitting, shrink fitting, or any other convenient method.

The protective ring 18 includes a cutting edge 20 for cutting through a first substance or substrate such as the steel casing or lining used in a subterranean drilling operation. The PCD layer 12 includes a cutting edge 22 for cutting through a second substance or substrate such as bedrock. In this arrangement, the tungsten carbide of the substrate 10 and the ring 16 is selected for its properties in forming the PCD layer 12 whilst the protective ring 18 is selected so as to optimize the drilling, milling or cutting through the relevant first substance or substrate. Although the annular ring 16 of tungsten carbide may act as a further protective layer for the cutting edge 22 of the PCD layer 12, its primary function is to optimize the formation of the PCD layer 12 in a conventional high pressure/high temperature process.

For convenience, the use of the tool insert will be described with regards to its use in the directional drilling of holes in a subterranean bedrock. It is to be understood, however, that the tool insert may be used in any application where a first substance or substrate, which is not suited for cutting, drilling or milling by a PCD cutter, is to be cut, drilled or milled to expose a second substance or substrate to which the PCD cutter is suited.

Figure 3:
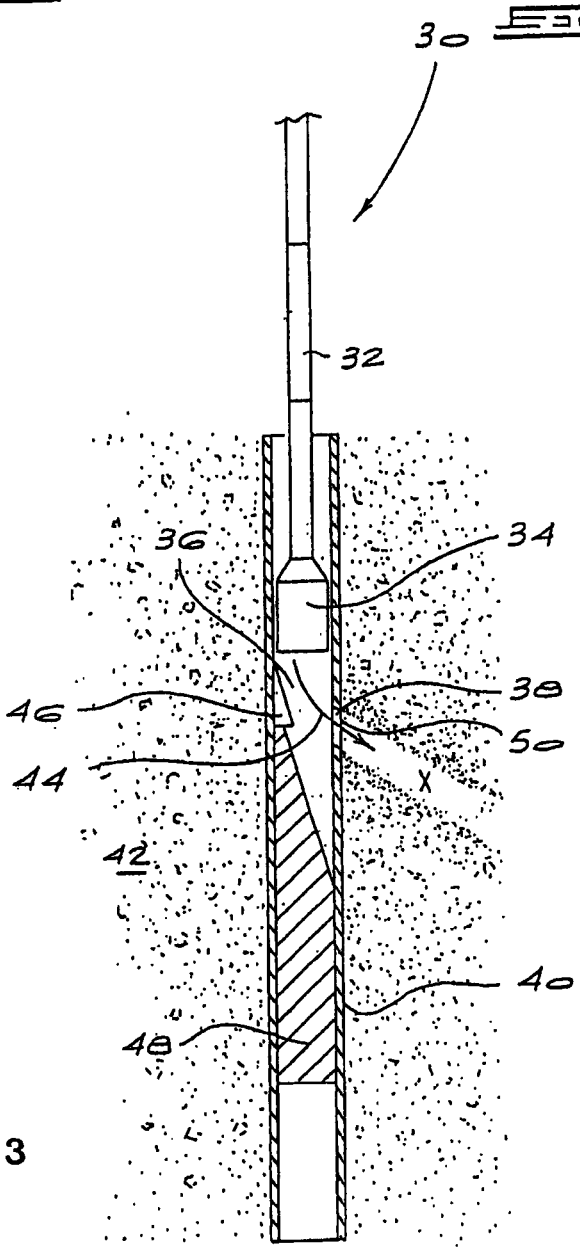
FIG. 3 is a schematic sectional side view of a rotary drill bit in a subterranean rock drilling operation.

Referring to FIG. 3 a drill assembly 30 consists of a rotary drill string 32 and a rotary drill bit 34, of the drag bit kind in this case.

The drill bit 34 is directed down a passage 36 within a steel tubular casing 38. The steel casing 38 is anchored in a borehole or shaft 40 drilled into a subterranean bedrock 42.

In order for the rotary drill bit 34 to drill a horizontal or angled hole into the bedrock 42 in the region indicated by an 'X', it is necessary for the drill bit 34 to be redirected from a vertical direction of movement to a horizontal or angled direction of movement, along the arrow 44. A deflector 46, which is attached to the casing 38 and which has previously been positioned adjacent the region 'X', causes the bit 34 to change direction in this manner. The deflector 46 is supported by an anchor 48.

In order to drill through the casing 38, typically-cemented tungsten carbide cutters have traditionally been used. Once a window 50 has been milled through the casing 38, the drill bit 34 is withdrawn and replaced with a drill bit having abrasion resistant cutters such as PCD cutters. This time consuming operation is obviated by using tool inserts or cutters of the invention. The protective layer or ring 18 is used to mill through the casing 38, whereafter it and the support ring 16 are quickly consumed to expose the cutting edge 22 of the PCD layer, which is suited to cutting through the subterranean bedrock.

The layer of ultra-hard abrasive material will generally be a layer of PCD, although it may also be PCBN where the second substrate requires it. The layer may also be a layer of diamond produced by chemical vapour deposition, called CVD diamond.

The substrate of the tool insert will generally be a cemented carbide substrate. Such substrates are well known in the art and are generally cemented tungsten carbide substrates.

The tool insert configuration may, where appropriate, be altered or adapted in different applications, provided that the desired purpose, i.e. of protecting the primary cutting edge of a PCD or PCBN layer whilst milling a window through a first substrate and exposing the PCD or PCBN cutting edge once a second substrate is encountered, is achieved.

The invention claimed is:

1. A tool insert comprising:

a substrate having a support surface and a support ring extending laterally from the support surface, the support ring being sized to define a recess within the confines thereof and a shelf about the periphery thereof, wherein the substrate is tungsten carbide substrate;

a layer of ultra-hard abrasive material located within the recess and bonded to the substrate and the support ring, the layer of ultra-hard abrasive material having a top surface, a portion of the periphery of the top surface providing a primary cutting edge for the tool insert; and a protective layer bonded to the shelf about the support ring so as to protect the primary cutting edge, a periphery of the protective layer providing a secondary cutting edge for the tool insert, the depth of the protective layer being selected so as to be sufficient to protect the primary cutting edge whilst cutting, milling or drilling through a first substance but to expose the primary cutting edge upon encountering a second substance, wherein the protective layer is formed of tungsten carbide of a different grade to that of the substrate, or of tool steel, dependent on the first substance to be drilled.

2. A tool insert according to claim 1, wherein the support ring is integrally formed with the substrate.

3. A tool insert according to claim 1, wherein the protective layer is formed in situ during the formation of the tool insert.

4. A tool insert according to claim 1, wherein the protective layer is formed as a separate ring component which is bonded to the shelf portion of the support surface of the substrate.

* * * * *

UNITED STATES PATENT AND TRADEMARK OFFICE

CERTIFICATE OF CORRECTION

PATENT NO. : 7,594,553 B2
APPLICATION NO. : 10/533269
DATED : September 29, 2009
INVENTOR(S) : Tank et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 269 days.

Signed and Sealed this

Twenty-eighth Day of September, 2010

David J. Kappos

David J. Kappos
*Director of the United States Patent and Trademark Office*